US007759591B2

(12) United States Patent
Kim et al.

(10) Patent No.: US 7,759,591 B2
(45) Date of Patent: Jul. 20, 2010

(54) PNEUMATIC MEMS SWITCH AND METHOD OF FABRICATING THE SAME

(75) Inventors: Che-heung Kim, Yongin-si (KR); Hyung Choi, Seongnam-si (KR); In-sang Song, Seoul (KR); Sang-hun Lee, Seoul (KR); Sang-wook Kwon, Seongnam-si (KR); Dong-kyun Kim, Suwon-si (KR); Young-tack Hong, Suwon-si (KR); Jong-seok Kim, Hwaseong-si (KR); Chang-seung Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 727 days.

(21) Appl. No.: 11/513,036

(22) Filed: Aug. 31, 2006

(65) Prior Publication Data

US 2007/0140614 A1 Jun. 21, 2007

(30) Foreign Application Priority Data

Dec. 15, 2005 (KR) ..... 10-2005-0124170

(51) Int. Cl.
*H01H 57/00* (2006.01)

(52) U.S. Cl. ..... 200/181; 335/78

(58) Field of Classification Search ..... 200/81–83, 200/512, 513, 515, 181; 335/78, 79
See application file for complete search history.

(56) References Cited

U.S. PATENT DOCUMENTS 5,452,878 A 9/1995 Gravesen et al.
5,526,172 A 6/1996 Kanack
5,619,061 A 4/1997 Goldsmith et al.

(Continued)

FOREIGN PATENT DOCUMENTS

EP 0709911 A2 5/1996

(Continued)

OTHER PUBLICATIONS

"An Electrostatically-Actuated Mems Switch for Power Applications"—Jo Ey Wong et al., Proceedings IEEE Micro Electro Mechanical Systems, Jan. 23, 2000, pp. 633-638.

*Primary Examiner*—Renee Luebke
*Assistant Examiner*—Marina Fishman
(74) *Attorney, Agent, or Firm*—Sughrue Mion, PLLC

(57) ABSTRACT

A pneumatic micro electro mechanical system switch includes a substrate, a pneumatic actuating unit disposed on the substrate; the pneumatic actuating unit having a plurality of variable air cavities communicating such that when one of the plurality of variable air cavities is compressed, the rest are expanded; a signal line having a plurality of switching lines, each of which passes through a corresponding one of the plurality of variable air cavities and has switching ends disposed in a spaced-apart relation with each other in the corresponding one of the plurality of variable air cavities; a movable switching unit to connect the first and the second switching ends of each of the plurality of switching lines if one of the plurality of variable air cavities is compressed; and a driving unit to drive the pneumatic actuating unit so as to selectively compress the plurality of variable air cavities.

19 Claims, 9 Drawing Sheets

U.S. PATENT DOCUMENTS

| | | | | |
|---|---|---|---|---|
| 6,168,395 | B1 | 1/2001 | Quenzer et al. | |
| 6,621,387 | B1 | 9/2003 | Hopcroft | |
| 6,655,923 | B1 | 12/2003 | Lisec et al. | |
| 6,858,811 | B2 * | 2/2005 | Fitzgerald et al. | 200/85 R |

FOREIGN PATENT DOCUMENTS

| | | | |
|---|---|---|---|
| JP | 8-21967 | A | 1/1996 |
| JP | 2001-502247 | A | 2/2001 |
| JP | 2001-347500 | A | 12/2001 |
| JP | 2003-264122 | A | 9/2003 |
| WO | 97/29538 | A1 | 8/1997 |
| WO | 03/069645 | A1 | 8/2003 |
| WO | 2004/019362 | A1 | 3/2004 |
| WO | 2005/101434 | A2 | 10/2005 |

* cited by examiner

PNEUMATIC MEMS SWITCH AND METHOD OF FABRICATING THE SAME

This application claims priority under 35 U.S.C. §119 (a) from Korean Patent Application No. 10-2005-124170 filed on Dec. 15, 2005 in the Korean Intellectual Property Office, the disclosure of which is incorporated herein by reference.

BACKGROUND OF THE INVENTION

1. Field of the Invention

The present invention relates to a Micro Electro Mechanical System (MEMS) switch, such as Radio Frequency (RF) switch, fabricated using a MEMS technique, and in particular to a MEMS switch using a pneumatic pressure, and a method of fabricating the same.

2. Description of the Related Art

In general, a MEMS switch, such as an RF switch, that is configured using a MEMS technique, includes a switch pad in the shape of a bridge or a cantilever, which is driven by a driving electrode. The switch pad is elastically supported on a substrate by a supporting spring. The driving electrode is formed opposite to the switch pad on the substrate so as to drive the switch pad.

In such a conventional MEMS switch, a driving voltage applied to the driving electrode depends on an elastic modulus of the supporting spring, which enables the switch, pad to come into contact with or move away from a signal line under the influence of an electrostatic force, thereby switching signal flow. Accordingly, in order to reduce the driving voltage applied to the driving electrode and switch the signal flow at a high speed, the supporting spring is usually designed to have a low elastic modulus below a certain level. As a result, the conventional MEMS switch presents a first problem in that the elastic force of the supporting spring which maintains switching contacts of the switch pad to move away from switching ends of the signal line weakens, thereby allowing the switch pad to be easily vibrated with a small external force, and a second problem in that a jointed portion between the supporting spring and the switch pad weakens, thereby resulting in fabrication defects.

In order to address these problems, a new concept of MEMS switches has been developed of removing a mechanism in which the switch pad repeats mechanical deformation and restoration through the supporting spring while being operated. These MEMS switches are disclosed in U.S. Pat. Nos. 6,294,847, 6,143,997 and 6,489,857.

A bistable micro-electromechanical switch of U.S. Pat. No. 6,294,847 uses two parallel plate capacitors that drive a dielectric beam attached to a movable transmission line segment. The bistable micro-electromechanical switch, however, has a disadvantage that in order to overcome a sticking problem, such as friction or collision of the movable transmission line segments generated while the dielectric beam is driven along with the movable transmission line segment, a relatively large of driving force is required. If a driving voltage applied to the capacitors is increased to increase the driving force, power consumption is not only increased, but also it is difficult for the bistable micro-electromechanical switch to be employed to a system or module such as a handset, an antenna tuner, a transmitting/receiving set, and a phased array antenna, which requires a MEMS switch drivable with a low driving voltage.

MEMS switches of U.S. Pat. Nos. 6,143,997 and 6,489,857 include a conductive pad or a movable body drivable by top and bottom driving electrodes or first and second field plates, and a bracket or a guidepost to guide the conductive pad or the movable body to go constantly up and down. However, since electrical connection to transmission lines, that is, signal flow, is switched by the conductive pad or the movable body which is guided along the bracket or the guidepost, there can arise a problem in that the electrical connection is cut off, or weakens. Further, the MEMS switches can arise a problem in that the conductive pad or the movable body is jammed due to fabrication tolerance or error between the bracket or the guidepost and a receiving opening of the conductive pad or the movable body while it is moving up and down, thereby deteriorating reliability in operation. However, to address these problems, if a driving voltage applied to the top and bottom driving electrodes or the first and the second field plates is increased, power consumption is not only increased, but also it is difficult for the MEMS switches to be employed to a system or module which is driven with a low driving voltage, similar to the bistable micro-electromechanical switch of U.S. Pat. No. 6,294,847.

Accordingly, there is required a new MEMS switch that can not only be stably operated, but also driven with a low driving voltage which satisfies a driving voltage condition of the system or module to be used without employing the supporting spring which should be designed to have the low elastic modulus below the certain level.

SUMMARY OF THE INVENTION

An aspect of the present invention is to address at least the above problems and/or disadvantages. Accordingly, an aspect of the present invention is to provide a pneumatic MEMS switch in which a pneumatic actuating unit has a plurality of variable air cavities communicating with one another, each of which operate to bring corresponding switching contacts of a switching unit into contact with, or separate from, switching ends of corresponding switching lines, thereby reducing a driving voltage and improving a reliability in operation and fabrication, and a method of fabricating the same.

Another aspect of the present invention is to provide a pneumatic MEMS switch in which switching contacts of a switching unit and switching ends of switching lines are not sealed by a separate packaging member and/or a separate packaging process, but by a membrane of a pneumatic actuating unit, thereby reducing fabrication costs, and a method of fabricating the same.

The above and or other aspects of the invention will be set forth in part in the description which follows and, in part, will be obvious from the description, or may be learned by practice of the invention.

According to an aspect of the present invention, a pneumatic MEMS switch comprises a substrate, a pneumatic actuating unit disposed on the substrate, the pneumatic actuating unit having a plurality of variable air cavities communicating with each other in such a manner that when at least one of plurality of variable air cavities is compressed, the rest are expanded, a signal line having a plurality of switching lines, each of which passes through a corresponding one of the plurality of variable air cavities and has a first and a second switching ends disposed in a spaced-apart relation with each other in the corresponding one of the plurality of variable air cavities, a switching unit movable with the pneumatic actuating unit to connect the first and the second switching ends of each of the plurality of switching lines with each other or disconnect the first and second switching ends from each other when each of the plurality of variable air cavities is compressed or expanded, and a driving unit to drive the pneumatic actuating unit so as to selectively compress the plurality of variable air cavities.

The substrate may be formed of a high resistivity silicon or a quartz.

The pneumatic actuating unit may comprise a membrane to close up a plurality of trenches formed at the substrate so as to communicate with each other, and thus to form the plurality of variable air cavities. The membrane may be formed of a silicon oxide film, a silicon nitride film or a parylene, which is a dielectric substance with a flexibility.

The membrane may have a plurality of first etching holes to remove a sacrificing layer pattern for forming the plurality of variable air cavities during a fabrication, and the plurality of first etching holes may be sealed with a seal. Alternatively, a portion or the whole of the plurality of first etching holes may be not sealed with a seal within a range where the membrane is operable in such a manner that when the at least one of the plurality of variable air cavities is compressed, the rest are expanded.

Each of the plurality of switching lines may comprise a coplanar wave guide (CPW) spaced apart from a ground formed on the plurality of trenches, so as to transmit a signal with an electronic field. The ground and the signal line may be formed of one selected from Au and Pt, respectively.

The switching unit may comprise a plurality switching contacts, each of which is formed opposite to the first switching end and the second switching end of each of the plurality of switching lines in each of the plurality of variable air cavities. The plurality of switching contacts may be formed of Au, Pt, Rh or Ir, respectively.

The driving unit may comprise a ground formed on the plurality of trenches in the plurality of variable air cavities, and a plurality of driving electrodes, each of which is formed opposite to the ground on a corresponding one of the plurality of trenches, at an outer surface of the membrane to generate an electrostatic force with the ground therebetween while being applied with a voltage and thus to compress corresponding one of the plurality of variable air cavities of the membrane. The plurality of driving electrodes may be formed of one selected from Al, Mo, and Ta, respectively.

Each of the plurality of driving electrodes may have a plurality of second etching holes to remove a sacrificing layer pattern for forming the plurality of variable air cavities during a fabrication, and the plurality of second etching holes may be sealed with a seal. Alternatively, a portion or the whole of the plurality of second etching holes may be not sealed with a seal within a range where the membrane is operable in such a manner that when the at least one of the plurality of variable air cavities is compressed, the rest are expanded.

In an exemplary embodiment, the plurality of trenches, the plurality of variable air cavities, the plurality of switching lines, the plurality of switching contacts, and the plurality of driving electrodes may comprise two trenches, two variable air cavities, two switching lines, two switching contacts, and two driving electrodes, respectively.

Alternatively, the plurality of trenches, the plurality of variable air cavities, the plurality of switching lines, the plurality of switching contacts, and the plurality of driving electrodes may comprise at least three trenches, at least three variable air cavities, at least three switching lines, at least three switching contacts, and at least three driving electrodes, respectively, and the plurality of trenches and the plurality of variable air cavities may be arranged in series and formed to communicate with one another, respectively.

Further, the plurality of trenches, the plurality of variable air cavities, the plurality of switching lines, the plurality of switching contacts, and the plurality of driving electrodes may comprise at least three trenches, at least three variable air cavities, at least three switching lines, at least three switching contacts, and at least three driving electrodes, respectively, and the plurality of trenches and the plurality of variable air cavities may be configured in such a manner that at least one of the plurality of trenches and the plurality of variable air cavities is disposed in a center of the rest and formed to communicate with one another, respectively.

Also, the plurality of trenches, the plurality of variable air cavities, the plurality of switching contacts, and the plurality of driving electrodes may constitute a plurality of switch units, each of which is formed of two trenches, two variable air cavities, two switching contacts, and two driving electrodes, and the plurality of switch units may be successively connected with one another in such a manner that one unit is disposed in parallel with another two units.

According to another aspect of the present invention, a method of fabricating a pneumatic micro electro mechanical system switch comprises forming a signal line and a ground on a substrate, forming a sacrificing layer pattern for forming a membrane over the substrate on which the signal line and the ground are formed, the membrane having a plurality of variable air cavities which communicate with each other, forming a plurality of switching contacts for switching the signal line on the sacrificing layer pattern, forming a membrane to cover the sacrificing layer pattern on the sacrificing layer pattern on which the plurality of switching contacts is formed, forming a plurality of driving electrodes opposite to the ground at the membrane, the plurality of driving electrodes operating to selectively compress the plurality of variable air cavities, and removing the sacrificing layer pattern.

The forming a signal line and a ground may comprises forming a groove part having a plurality of trenches communicating with each other on the substrate, and forming a signal line and a ground on the substrate on which the groove part is formed, the signal line having a plurality of switching lines, each of which is disposed across a corresponding one of the plurality of trenches and has a first and a second switching ends disposed in the corresponding one of the plurality of trenches, and the ground being spaced apart from the plurality of switching lines the signal line with a gap.

The forming a groove part may comprise forming a groove part etching mask pattern for forming the groove part on the substrate, etching the substrate by using the groove part etching mask pattern as an etching mask, and removing the groove part etching mask pattern. The groove part etching mask pattern may be formed of one selected from silicon oxide film, nitride film, a photo resist, an epoxy resin, and a metal. Alternatively, if etching holes or passages for etching and removing the sacrificing layer pattern is not formed at the membrane, but at the substrate, the groove part etching mask pattern may further comprises an etching passage pattern for forming a plurality of etching passages, which etch and remove the sacrificing layer pattern, on the substrate.

The substrate may be formed of a high resistivity silicon or a quartz. The etching the substrate may be carried out by dry-etching when the substrate is formed of the high resistivity silicon, and by wet-etching when the substrate is formed of the quartz.

The forming a signal line and a ground on the substrate on which the groove part is formed may comprise forming a first metal layer on the on the substrate on which the groove part is formed, and patterning the first metal layer to form the signal line and the ground. The first metal layer may be formed of Au or Pt.

The forming a sacrificing layer pattern may comprise forming a first sacrificing layer over the substrate on which the signal line and the grounds are formed, patterning the first sacrificing layer to form a first air cavity sacrificing layer pattern for forming at least one of the plurality of variable air cavities, which is in a compressed state, curing the substrate over which the first air cavity sacrificing layer pattern is formed, forming a second sacrificing layer on the cured substrate, patterning the second sacrificing layer to form a second air cavity sacrificing layer pattern for forming the rest except the at least one of the plurality of variable air cavities, which are in an expanded state, and curing the substrate over which the second air cavity sacrificing layer pattern is formed. The first and the second sacrificing layers may be formed of a photo resist.

The forming a plurality of switching contacts may comprise forming a second metal layer over the substrate over which the sacrificing layer pattern is formed, and patterning the second metal layer to form a plurality of switching contacts opposite to the first and the second switching ends of each of the plurality of switching lines of the signal line. The second metal layer may be formed of Au, Pt, Rh or Ir.

The forming a membrane may comprise forming a membrane layer over the substrate over which the plurality of switching contacts are formed, and patterning the membrane layer to form a membrane which covers the sacrificing layer pattern. The membrane layer may be formed of a silicon oxide film, a silicon nitride film, or a parylene, which is a dielectric substance with a flexibility.

The forming a plurality of driving electrodes may comprise forming a third metal layer over the substrate over which the membrane is formed, and patterning the third metal layer to form a plurality of driving electrodes opposite to a plurality of variable air cavities in the membrane, respectively. The third metal layer may be formed of Al, Mo, or Ta. Alternatively, if the etching holes or passages for etching and removing the sacrificing layer pattern is not formed at the substrate, but at the first and the second driving electrodes and the membrane, the patterning the third metal layer may further comprise patterning the third metal layer in such a manner that each of the plurality of driving electrodes further comprises a plurality of second etching holes for etching and removing the sacrificing layer pattern, and the patterning the third metal layer to form a plurality of driving electrodes may further comprise patterning the third metal layer in such a manner that the membrane further comprises a plurality of first etching holes for etching and removing the sacrificing layer pattern.

The removing the sacrificing layer pattern may comprise removing the sacrificing layer pattern through the plurality of first and second etching holes by using a wet-etching process or an ashing process.

In this case, the fabrication method may further comprise sealing the plurality of first and second etching holes.

The sealing the plurality of first and second etching holes may comprise forming a sealing layer over the substrate from which the sacrificing layer pattern is removed and patterning the sealing layer to form a seal which seals the plurality of first and second etching holes. Like as the membrane layer, the sealing layer may be formed of a silicon nitride film, a silicon oxide film, or a parylene, which is a dielectric substance with a flexibility.

Alternatively, the patterning the sealing layer may be carried out in such a manner that a portion or the whole of the plurality of first and second etching holes is not sealed with the seal within a range where the membrane is so operable that when at least one of the plurality of variable air cavities is compressed, the rest of the plurality of variable air cavities are expanded.

Alternatively, the removing the sacrificing pattern may comprises removing the sacrificing layer pattern through the plurality of etching passages by using a wet-etching process or an ashing process.

In this case, the fabrication method may further comprise sealing the plurality of etching passages. The sealing the plurality of etching passages may comprise inserting metal balls into the plurality of etching passages formed at the substrate from which the sacrificing layer pattern is removed, and heating the substrate to fuse the metal balls with heat and thus to seal the plurality of etching passages. At this time, the fabrication method may further comprise forming a protecting layer on the plurality of driving electrodes to protect the plurality of driving electrodes.

BRIEF DESCRIPTION OF THE DRAWINGS

The above and other aspects and features of the present invention will be more apparent from the description for exemplary embodiments of the present invention taken with reference to the accompanying drawings, in which.

Throughout the drawings, the same drawing reference numerals will be understood to refer to the same elements, features, and structures.

DETAILED DESCRIPTION OF ILLUSTRATIVE, NON-LIMITING EMBODIMENTS OF THE INVENTION

The matters defined in the description such as a detailed construction and elements are provided to assist in a comprehensive understanding of the embodiments of the invention and are merely exemplary. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

Figure 1A:
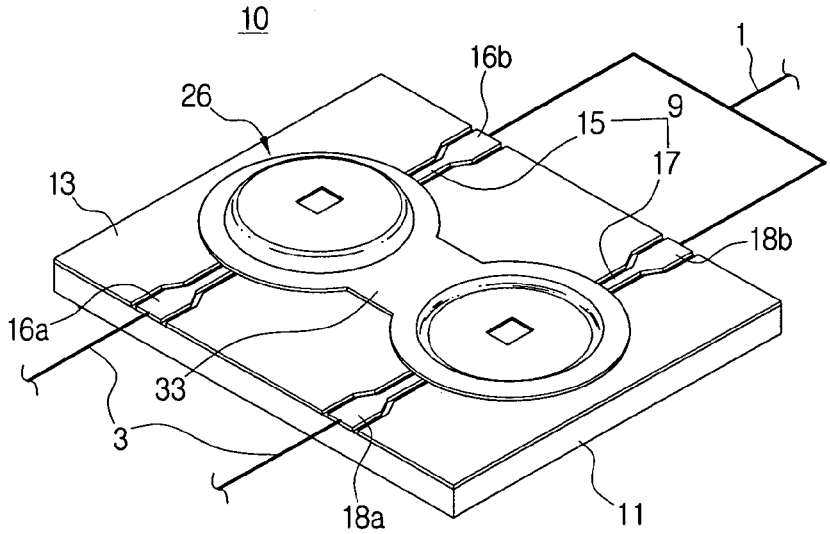
FIGS. 1A and 1B are a perspective view and a cross-sectional view exemplifying a pneumatic RF MEMS switch in accordance with an exemplary embodiment of the present invention when a second switching line is in a 'ON' state.
Figure 1B:
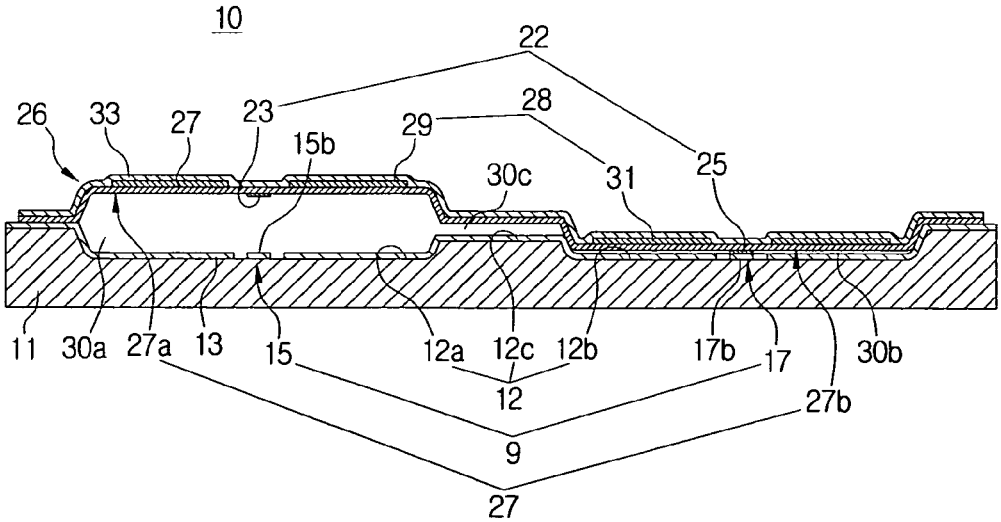

FIGS. 1A and 1B schematically show a pneumatic RF MEMS switch 10 in accordance with an exemplary embodiment of the present invention.

The pneumatic RF MEMS switch 10 comprises a substrate 11, a groove part 12, a signal line 9, a pneumatic actuating unit 26, a switching unit 22 and a driving unit 28.

The substrate 11 is formed of a high resistivity silicon or a quartz.

Figure 3A:
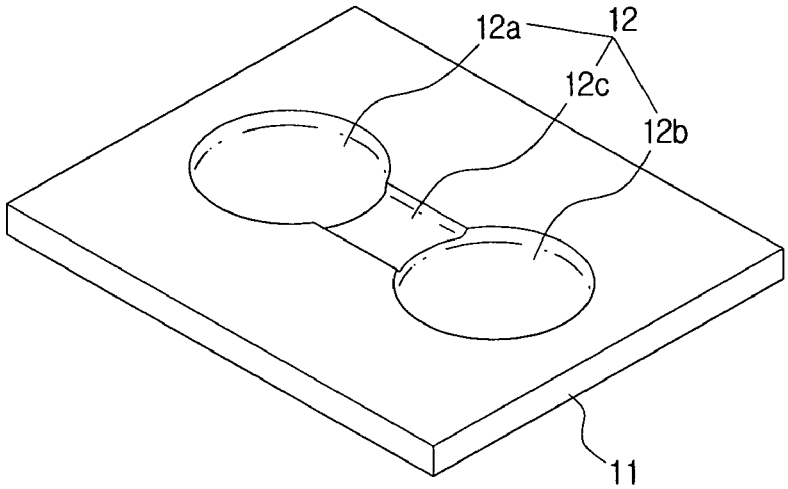
FIGS. 3A through 3F are perspective views exemplifying a process of fabricating the pneumatic RF MEMS switch of FIGS. 1A and 1B.

As shown in FIGS. 1B and 3A, the groove part 12 is provided with a first and a second trenches 12*a* and 12*b*, which are formed at a surface, that is, an upper surface of the substrate 11 to communicate with each other through a connecting passage 12*c*. The connecting passage 12*c* is preferably formed in a depth more shallow than that of the first and the second trenches 12*a* and 12*b*, but it can be instead formed in a depth equal to than that of the first and second trenches 12*a* and 12*b*.

The signal line 9 includes a first and a second switching lines 15 and 17, which are disposed on the substrate 11 across the first and the second trenches 12*a* and 12*b*, respectively. The first and the second switching lines 15 and 17 are made up of a coplanar wave guide (CPW), which is spaced apart from a ground 13 to generate an electronic field with the ground 13 therebetween and thereby to transmit a signal. The ground 13 is formed on the substrates 11 including the first and the second trenches 12*a* and 12*b*. The first and the second switching lines 15 and 17 and the ground 13 are preferably formed of Au or Pt, which has a good signal transmission characteristic.

The first and the second switching lines 15 and 17 are connected to a main line 1 through a first and a second input connecting pads 16*b* and 18*b*, respectively and connected to a branch line 3 through a first and a second output connecting pads 16*a* and 18*a*, respectively.

Figure 4:
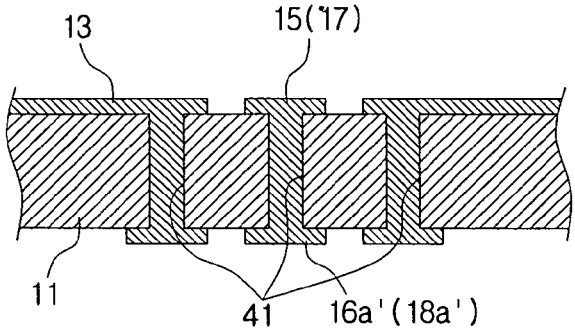
FIG. 4 is a partial cross-sectional view exemplifying another example of a connecting pad of a first and a second switching lines of the pneumatic RF MEMS switch of FIGS. 1A and 1B.

The connecting pads 16*b*, 18*b*, 16*a* and 18*a* are formed on the upper surface of the substrate 11, like as the ground 13, but as shown at 16*a*' and 18*a*' of FIG. 4, they can be formed on a undersurface of the substrate 11 through via hole 41, if necessary.

Figure 3B:
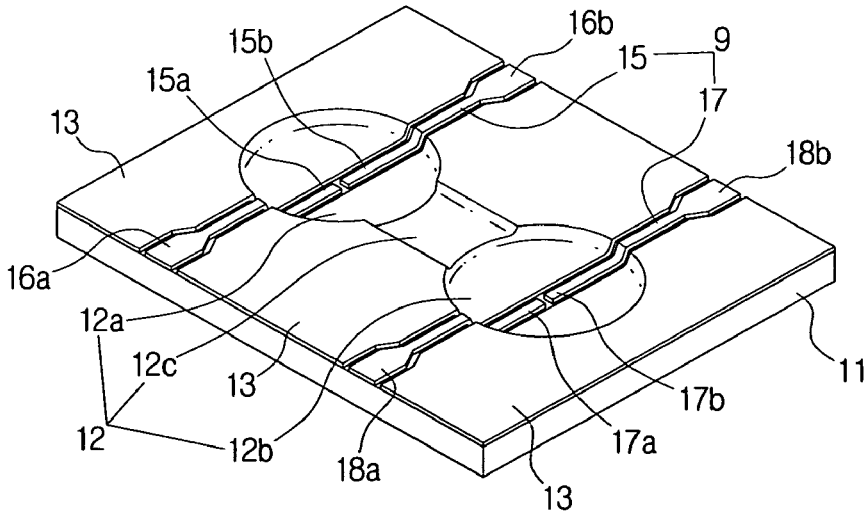

Also, as shown in FIG. 3B, the first and the second switching lines 15 and 17 are provided with first and second switching ends 15*a* and 15*b*; and 17*a* and 17*b*, which are disposed in the first and the second trenches 12*a* and 12*b*, respectively. The first and the second switching ends 15*a* and 15*b*; and 17*a* and 17*b* are connected with or disconnected from each other by a first and a second switching contacts 23 and 25 of the switching unit 22 to be described below, respectively, so as to transmit or block the signal.

The pneumatic actuating unit 26 is operated by the driving unit 28, to bring or separate the first and the second switching contacts 23 and 25 in contact with, or from the first and the second switching ends 15*a* and 15*b*; and 17*a* and 17*b*, respectively. The pneumatic actuating unit 26 includes a membrane 27.

The membrane 27 is formed on the ground 13 to close up the groove part 12, and is provided with a first and a second flexible domes 27*a* and 27*b*. The first and the second flexible domes 27*a* and 27*b* constitute a first and a second variable air cavities 30*a* and 30*b* communicating with each other through a communicating cavity 30*c*, respectively. Air is filled only in one of the first and the second variable air cavity 30*a* and 30*b*.

Accordingly, as shown in FIG. 1B, when a first driving electrode 29 or a second driving electrode 31, e.g., the second driving electrode 31 of the driving unit 28 is applied with a voltage, the second flexible dome 27*b* of the membrane 27 is compressed and lowered toward the ground 13 by an electrostatic force generating between the second driving electrode 31 and the ground 13. As a result, the air in the second variable air cavity 30*b* moves to the first variable air cavity 30*a* through the communicating cavity 30*c*, so that the first variable air cavity 30*a* is enlarged in volume to expand and eject upward the first flexible dome 27*a*.

The membrane 27 is formed of a flexible dielectric substance, e.g., a silicon oxide film, a silicon nitride film or a parylene, so that it can be compressed or expanded with a small force.

Figure 5:
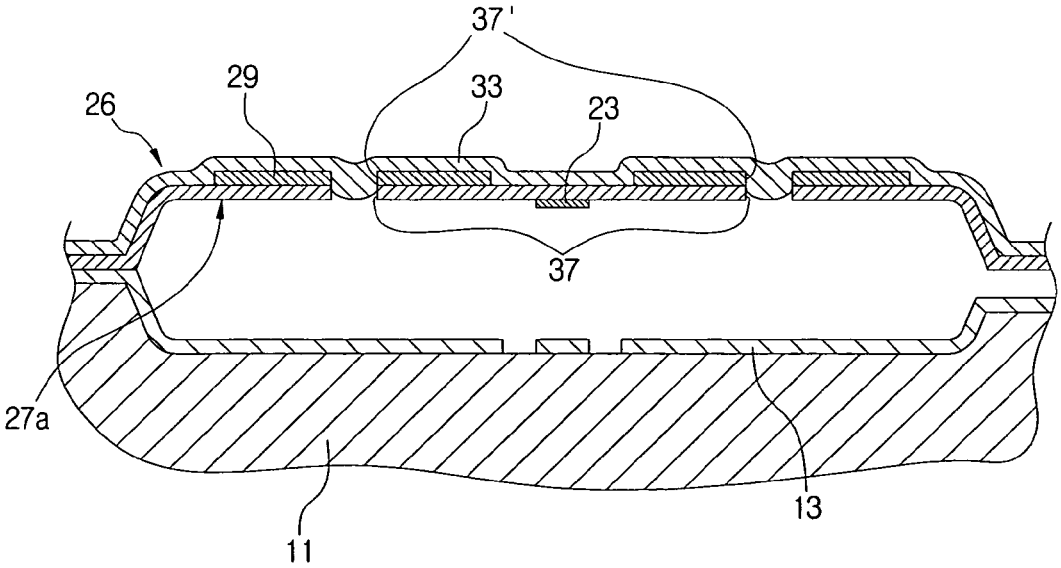
FIG. 5 is a magnified cross-sectional view exemplifying a seal which seals first etching holes of a membrane and second etching holes of a first and a second driving electrodes of the pneumatic RF MEMS switch of FIGS. 1A and 1B.

As shown in FIG. 5, the membrane 27 includes a plurality of first etching holes 37 to etch and remove a first and a second sacrificing layer patterns 19 and 21 (see FIG. 3D), for forming the first and the second variable air cavities 30*a* and 30*b* during a fabrication.

After the first and the second driving electrodes 29 and 31 of the driving unit 28 are formed on the membrane 27, the plurality of first etching holes 37 are sealed by a seal 33 along with a plurality of second etching holes 37' formed at the first and the second driving electrodes 29 and 31. The seal 33 is formed of the same material as that of the membrane 27, e.g., a silicon nitride film, a silicon oxide film, or a parylene.

Here, although the first and the first etching holes 37 and 37' are explained as completely sealed by the seal 33, but they can be configured in such a manner that a portion or the whole thereof is not sealed with the seal 33 within a range, e.g., a range having an air leakage of 10%, where when the first or the second flexible dome 27*a* or 27*b* is compressed and lowered toward the ground 13 due to the electrostatic force generated by the first and the second driving electrode 29 or 31 between the first or the second driving electrode 29 or 31 and the ground 13, the air in corresponding first or second variable air cavity 30*a* or 30*b* can move to the other first or second variable air cavity 30*a* or 30*b* through the communicating cavity 30*c*, so that the other first or second variable air cavity 30*a* or 30*b* is enlarged in volume to expand and eject upward corresponding first or second flexible dome 27*a* or 27*b*.

The switching unit 22, which connects and disconnects the first and second switching ends 15*a* and 15*b*; and 17*a* and 17*b* of the first and the second switching lines 15 and 17, includes a first and a second switching contacts 23 and 25. The first and the second switching contacts 23 and 25 are formed on inner surfaces of the first and the second flexible domes 27*a* and 27*b* of the membrane 27 opposite to the first and second switching ends 15*a* and 15*b*; and 17*a* and 17*b* of the first and the second switching lines 15 and 17 disposed in the first and the second variable air cavities 30*a* and 30*b*, respectively. The first and the second switching contacts 23 and 25 are preferably formed of Au, Pt, Rh or Ir, which have good signal transmission characteristics.

The driving unit 28, which operates to selectively compress the first and the second flexible dome 27*a* and 27*b* of the membrane 27, includes a ground 13, and a first and a second driving electrodes 29 and 31.

As shown in FIG. 3B, the ground 13 is formed on the substrate 11 including the first and the second trenches 12*a* and 12*b* in the first and the second variable air cavities 30*a* and 30*b*.

The first and the second driving electrodes 29 and 31 are formed on outer surfaces of the first and the second flexible domes 27*a* and 27*b* of the membrane 27 opposite to the ground 13. The first and the second driving electrodes 29 and 31 are connected to a power supply (not shown) by a connecting line (not shown). The first and the second driving electrodes 29 and 31 are preferably formed, of Al, Mo or Ta, which have good electric conductivity.

When the first or the second driving electrode 29 or 31 is applied with a voltage, an electrostatic force is produced between the first or the second driving electrode 29 or electrode 31 and the ground 13 formed in the corresponding first or second variable air cavity 30*a* or 30*b*. Accordingly, either the corresponding first or second flexible dome 27*a* or 27*b* of the membrane 27 is compressed by the electrostatic force and lowered toward the ground 13. As a result, the other first or the second flexible domes 27*a* or 27*b* which is not compressed by the electrostatic force is expanded and ejected upward by the air pressure, as explained with reference to FIG. 1B.

Hereinafter, an operation of the pneumatic RF MEMS switch 10 constructed as above will be described in detail with reference to FIGS. 1A through 2.

First, in order to transmit a signal from the main line 1 to one of the branch lines 3, if a voltage is applied to the first driving electrode 29, an electrostatic force is produced between the first driving electrode 29 and the ground 13, and the first flexible dome 27*a* of the membrane 27 is pushed and lowered downwards toward the ground 13 by the electrostatic force.

Figure 2:
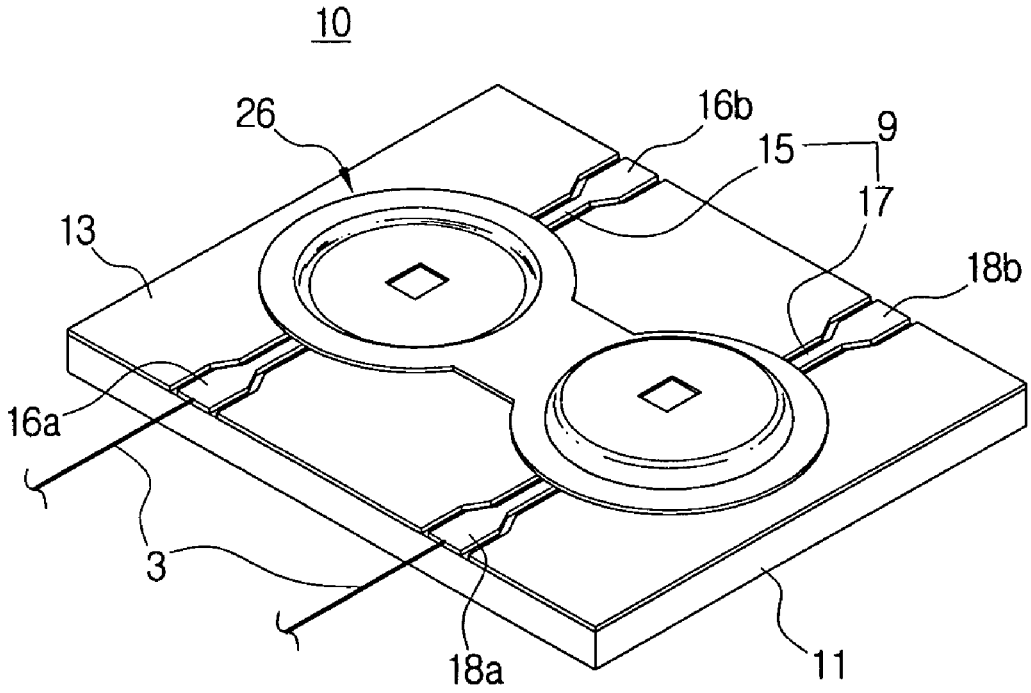
FIG. 2 is a perspective view exemplifying the pneumatic RF MEMS switch of FIG. 1A when a first switching line is in a 'ON' state.

Accordingly, the first flexible dome 27*a* of the membrane 27 is moved from a position shown in FIGS. 1A and 1B to a position shown in FIG. 2, and air in the first variable air cavity 30*a* is moved to the second variable air cavity 30*b* through the communicating cavity 30*c*. As the second variable air cavity 30*b* is enlarged in volume by the air entered from the first variable air cavity 30*a*, the second flexible dome 27*b* of the membrane 27 is expanded.

As a result, the first switching contact 23 of the switching unit 22 formed in the inner surface of the first flexible dome 27*a* is positioned at an 'ON' position which connects the first and the second switching ends 15*a* and 15*b* of the first switching line 15 in the first variable air cavity 30*a* with each other to pass a signal therebetween, and the second switching contact 25 of the switching unit 22 formed in the inner surface of the second flexible dome 27*b* is positioned at an 'OFF' position which disconnects the first and the second switching ends 17*a* and 17*b* of the second switching line 17 in the second variable air cavity 30*b* from each other to block a signal therebetween.

To the contrary, if a voltage is applied to the second driving electrode 31, an electrostatic force is produced between the second driving electrode 31 and the ground 13, and the second flexible dome 27*b* of the membrane 27 is pushed and lowered downwards toward the ground 13 by the electrostatic force.

Accordingly, the second flexible dome 27*b* of the membrane 27 is moved from a position shown in FIG. 2 to a position shown in FIGS. 1A and 1B, and the air in the second variable air cavity 30*b* is moved to the first variable air cavity 30*a* through the communicating cavity 30*c*. As the first variable air cavity 30*a* is enlarged in volume by the air entered from the second variable air cavity 30*b*, the first flexible dome 27*a* of the membrane 27 is expanded.

As a result, the second switching contact 25 of the switching unit 22 is positioned at an 'ON' position which connects the first and the second switching ends 17*a* and 17*b* of the second switching line 17 to pass a signal therebetween, and the first switching contact 23 of the switching unit 22 is positioned at an 'OFF' position which disconnects the first and the second switching ends 15*a* and 15*b* of the first switching line 15 to block a signal therebetween.

Figure 6:
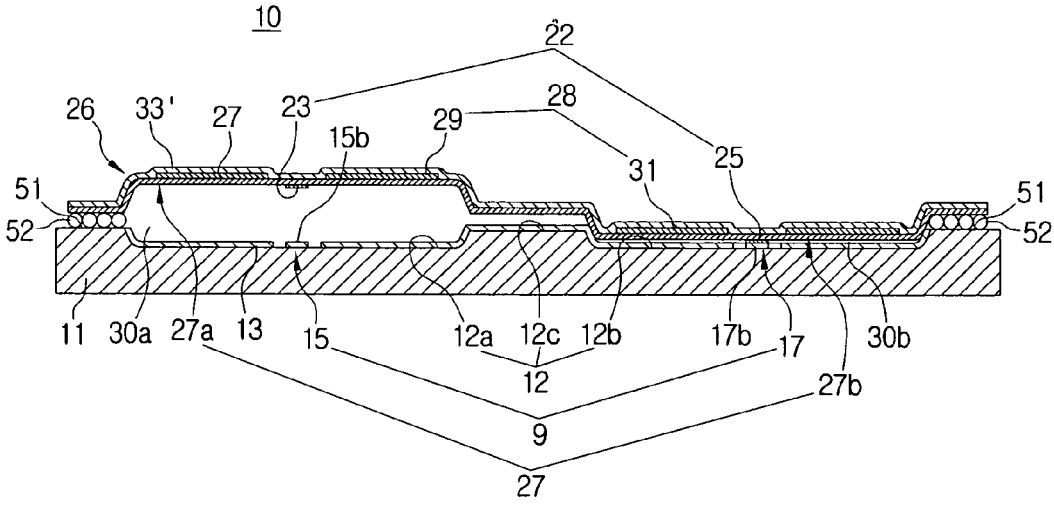
FIG. 6 is a cross-sectional view exemplifying etching passages which are formed at a substrate when the first and the second etching holes are not formed at the membrane and the first and the second driving electrodes of the pneumatic RF MEMS switch of FIGS. 1A and 1B.

As previously described, according to the pneumatic RF MEMS switch 10 of the exemplary embodiment of the present invention, the membrane 27 and the first and the second driving electrodes 29 and 31 have the plurality of first and second etching holes 37 and 37' to etch and remove the first and the second air cavity sacrificing layer pattern 19 and 21 for forming the first and the second variable air cavities 30*a* and 30*b* during the fabrication. However, the present invention is not limited that. For instance, as shown in FIG. 6, the RF pneumatic RF MEMS switch 10 in accordance with the exemplary embodiment of the present invention can be configured to have a plurality of etching passages 51 which communicate between the first and the second trenches 12*a* and 12*b* and the outside of the substrate 11, instead of the first and the second etching holes 37 and 37' formed at the membrane 27 and the first and the second driving electrodes 29 and 31. At this time, the etching passages 51 are sealed with metal balls 52 made of a metal such as Au. After the first and the second air cavity sacrificing layer pattern 19 and 21 is removed to form the first and the second variable air cavities 30*a* and 30*b*, the metal balls 52 are inserted into the etching passages 51, and the substrate 11 in which the metal balls 52 are inserted into the etching passages 51 is heated so as to allow the metal balls 52 to be fused in the etching passages 51 thus to seal the etching passages 51. In this case, the first and the second driving electrodes 29 and 31 are protected by a protecting layer 33' which is formed of the same material as that of the membrane 27.

Also, according to the pneumatic RF MEMS switch 10 of the exemplary embodiment of the present invention, the groove part 12, the pneumatic actuating unit 26, the switching unit 22, and the driving unit 28 are made up of two trenches 12*a* and 12*b*, the membrane 27 having two flexible domes 27*a* and 27*b* to form two variable air cavities 30*a* and 30*b* communicating with each other, two contacts 23 and 25, and two driving electrodes 29 and 31, respectively. However, the present invention is not limited that.

Figure 7:
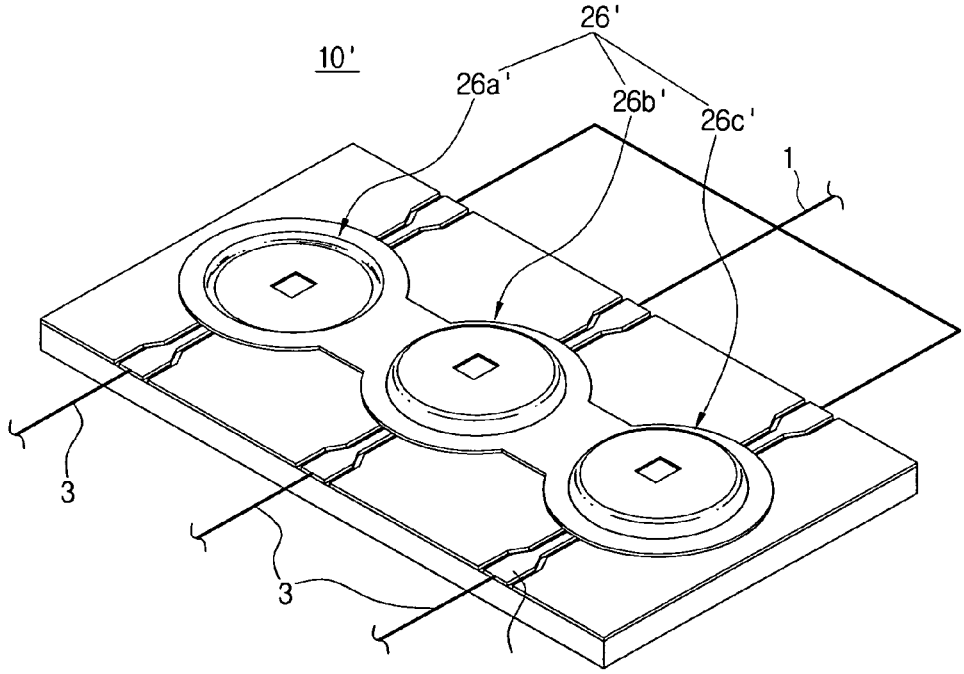
FIG. 7 is a perspective view exemplifying a modified example of the pneumatic RF MEMS switch in accordance with the exemplary embodiment of the present invention.

For instance, as shown in FIG. 7, a pneumatic RF MEMS switch 10' in accordance with the exemplary embodiment of the present invention can be configured in such a manner that a pneumatic actuating unit 26' is formed of a membrane (not shown) having a plurality of, e.g., three flexible domes, that is, a first, a second, and a third flexible domes 26*a*', 26*b*' and 26*c*' which are connected in series. In this case, two out of three variable air cavities of three flexible domes of the membrane are filled with air, so that when one of the variable air cavities decreased in volume, the rest can be correspondingly increased in volume. Accordingly, when a voltage is applied to any one of driving electrodes (not shown) formed to the first, the second, and the third flexible domes 26*a*', 26*b*' and 26*c*' of the membrane, e.g., a first driving electrode of the first flexible dome 26*a*', the first flexible dome 26*a*' of the membrane is compressed by a electrostatic force produced between a ground and the first driving electrode. Accordingly, air in the first variable air cavity of the first flexible dome 26*a*' is moved to the rest, that is, the second and the third variable air cavities of the second and the third flexible domes 26*b*' and 26*c*' to expand the second and the third flexible domes 26*b*' and 26*c*' of the membrane. As a result, as shown in FIG. 7, a first switching contact of the first flexible dome of the membrane is positioned at an 'ON' position which connects a first and a second switching ends (not shown) of a first switching line (not shown) in the first variable air cavity with each other to pass a signal therebetween, and a second and a third switching contacts of the second and the third flexible domes of the membrane are positioned at 'OFF' positions which disconnect a first and a second switching ends (not shown) of a second and a third switching lines (not shown) in the second and the third variable air cavities with each other to block a signal therebetween, respectively.

Figure 8:
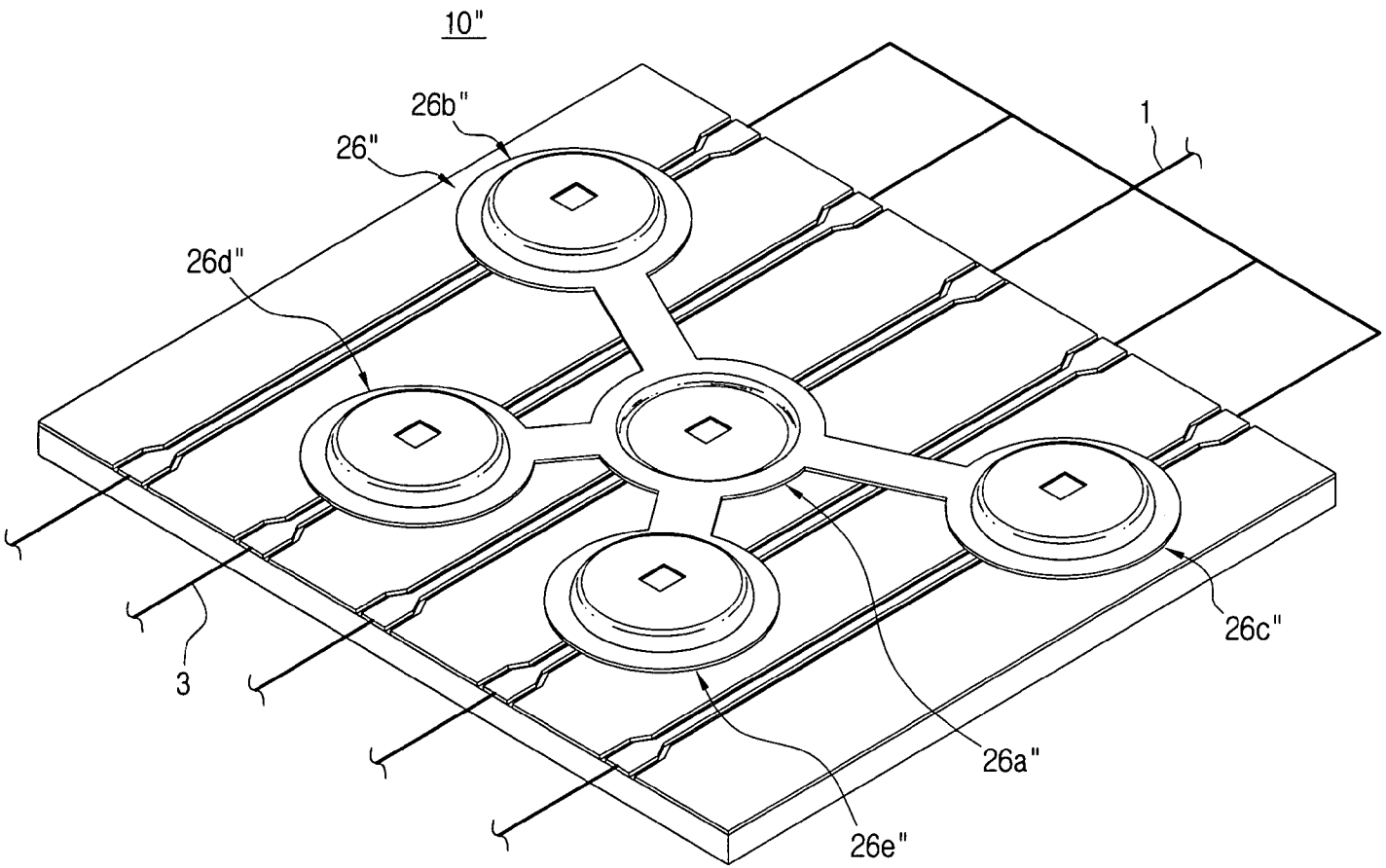
FIG. 8 is a perspective view exemplifying another modified example of the pneumatic RF MEMS switch in accordance with the exemplary embodiment of the present invention.

Also, as shown in FIG. 8, a pneumatic RF MEMS switch 10" in accordance with the exemplary embodiment of the present invention can be configured, so that a pneumatic actuating unit 26" is formed of a membrane (not shown) having a plurality of, e.g., five flexible dome portions, that is, a first, a second, a third, a fourth and a fifth flexible dome portions 26*a*", 26*b*", 26*c*". 26*d*" and 26*e*" which are communicated with one another, and which are arranged in such a manner that a first variable air cavity (not shown) of the first flexible dome 26*a*" is disposed in a center of a second, a third, a fourth, and a fifth variable air cavities (not shown) of the second, the third, the fourth, and the fifth flexible domes 26*b*", 26*c*". 26*d*" and 26*e*". In this case, like as the RF pneumatic RF MEMS switch 10', four out of five variable air cavities of five flexible domes of the membrane are filled with air, so that when one of the five variable air cavities is decreased in volume, the rest is correspondingly increased in volume. Accordingly, an operation of the pneumatic RF MEMS switch 10" is the same as that of the pneumatic RF MEMS switch 10' explained with reference to FIGS. 1A through 2, except for a number of the branch lines 3 which are switched.

Figure 9:
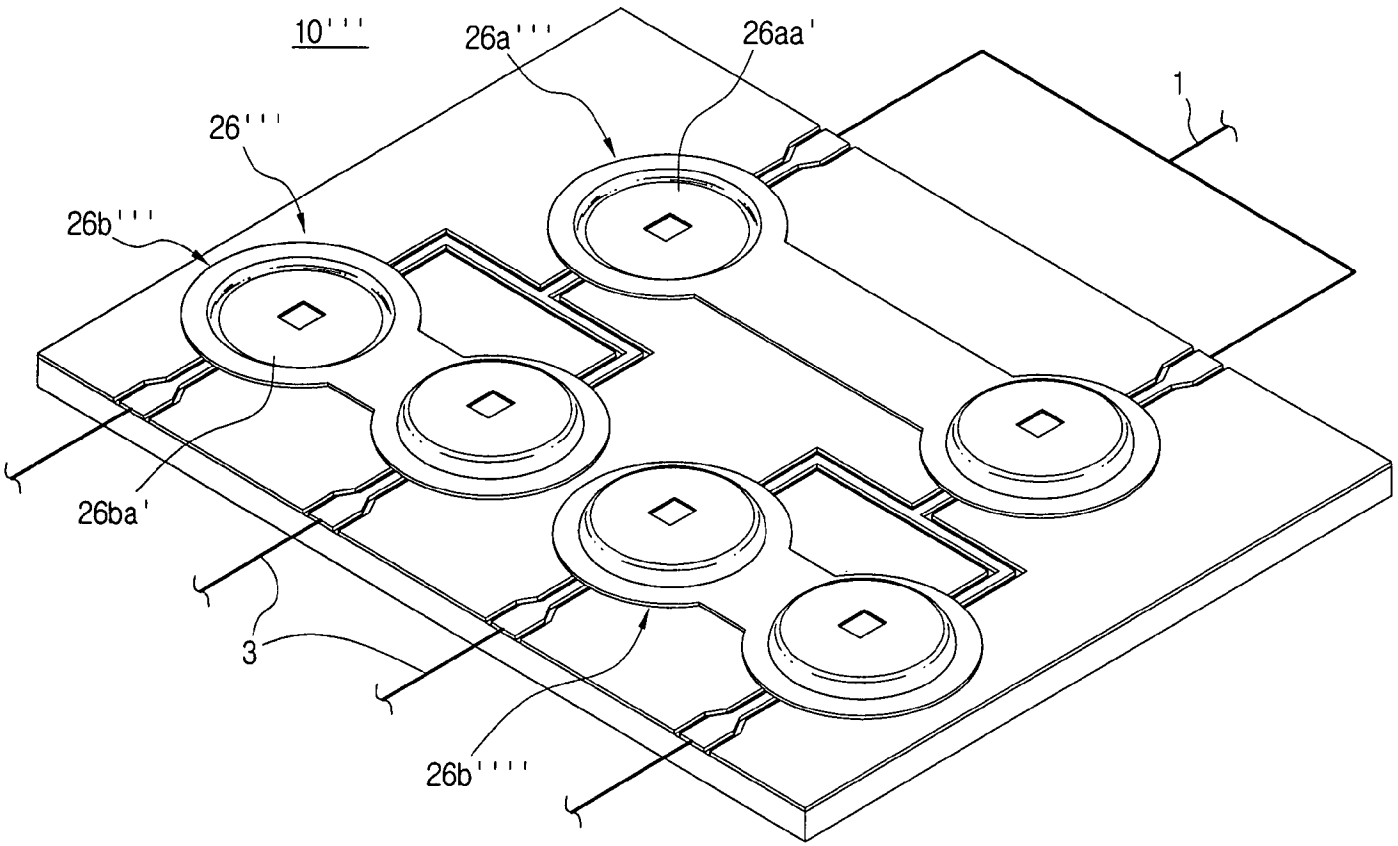
FIG. 9 is a perspective view exemplifying still another modified example of the pneumatic RF MEMS switch in accordance with the exemplary embodiment of the present invention.

Also, as shown in FIG. 9, the pneumatic RF MEMS switch 10''' in accordance with the exemplary embodiment of the present invention can be configured, so that a pneumatic actuating unit 26''' is formed of a plurality of small pneumatic actuating units, e.g., three small pneumatic actuating units 26*a*''', 26*b*''', and 26*b*'''', each having the same structure of that of the pneumatic actuating unit 26 of the pneumatic RF MEMS switch 10 shown in FIGS. 1A through 2. The three small pneumatic actuating units 26*a*''', 26*b*''', and 26*b*'''' are successively connected with one another in such a manner that one unit 26*a*" is arranged in parallel with another two units 26*b*" and 26*b*''''. In this case, the pneumatic RF MEMS switch 10''' is operated using the same principle as that of the pneumatic RF MEMS switch 10' explained with reference to FIGS. 1A through 2, except that in order to transmit a signal from the main line 1 to one of the branch lines 3, two driving electrodes, e.g., a first driving electrode (not shown) a driving unit (not shown) disposed at a first dome 26*aa*' of the first small pneumatic actuating unit 26*a*" and a first driving electrode (not shown) of a driving unit (not shown) disposed at a first dome 26*ba*' of one (that is, the first small pneumatic actuating unit 26*b*''') of the second and the third small pneumatic actuating unit 26*b*" and 26*b*'''' are simultaneously driven.

A method of fabricating the pneumatic RF MEMS switch 10 in accordance with the exemplary embodiment of the present invention constructed as above will be described in detail with reference to FIGS. 3A through 6, as follows.

First, as shown in FIG. 3A, after a substrate 11 made of a high resistivity silicon or a quartz is prepared, a groove part 12 having a first and a second trenches 12*a* and 12*b* communicating with each other through a connecting passage 12*c* is formed at the substrate 11.

More specifically, to form the groove part 12, a photoresist is thickly coated on the substrate 11, and then the photoresist is patterned by a photolithography process which exposures it to a light and develops it by using a mask including a pattern of the groove part 12. As a result, a groove part etching mask pattern (not shown) is formed on the substrate 11.

At this time, the groove part etching mask pattern can be formed by a method of depositing or sputtering a silicon oxide film, a silicon nitride film, an epoxy resin film, a pure metal film and etc., instead of patterning the photoresist by the photolithography process.

If alternatively, to etch and remove a first and a second air cavity sacrificing layer pattern 19 and 21 for forming a first and a second variable air cavities 30*a* and 30*b*, a plurality of etching passages 51 (see FIG. 6) are formed at the substrate 1, instead of forming a first and a second etching holes 37 and 37' at a membrane 27 and a first and a second driving electrodes 29 and 31, the groove part etching mask pattern can be configured to further include a pattern of the etching passages 51, so that the etching passages 51 can be formed at the substrate 11 during the following etching process.

After the groove part etching mask pattern is formed, the substrate 11 is etched by using the groove part etching mask pattern as an etching mask. At this time, if made of the high resistivity silicon, the substrate 11 is dry-etched by using $SF_6$ gas and the like having an etching selectivity with respect to the silicon substrate as an etching gas, and if made of the quartz, it is wet-etched by using an etching solution having an etching selectivity with respect to the quartz as an etching solution.

As a result, as shown in FIG. 3A, the groove part 12 having the first and the second trenches 12*a* and 12*b* is formed at an upper surface of the substrate 11.

Subsequently, the groove part etching mask pattern and organic matters entered onto the substrate 11 during the etching process are removed.

Next, on the substrate 11 at which the groove part 12 is formed, a first metal layer (not shown) is formed with Au or Pt by a sputtering process, a vacuum evaporation process and the like.

Thereafter, a signal line and ground etching mask pattern (not shown) is formed on the first metal layer by a photolithography process. That is, a photoresist is formed on the first metal layer, and exposed to a light and developed by using a photomask having a pattern of a first and a second switching lines 15 and 19 of the signal line 9 and a ground 13. As a result, the signal line and ground etching mask pattern is formed. At this time, if the plurality of etching passages 51 to etch and remove the first and the second air cavity sacrificing layer pattern 19 and 21 are formed at the substrate 11, the signal line and ground etching mask pattern is configured to further include the pattern of the etching passages 51, so that the signal line 9 and the ground 13 will not be formed on a portion of the substrate 11 at which the etching passages 51 are formed, during the following etching process.

After the signal line and ground etching mask pattern is formed, the first metal layer is patterned by a dry or a wet etching process which uses the signal line and ground etching mask pattern as an etching mask, and then the signal line and ground etching mask pattern is removed. As a result, as shown in FIG. 3B, the first and the second switching lines 15 and 19 of the signal line 9 and the ground 13 are formed on the substrate 11.

Here, it should be noted that although the process of forming the first and the second switching lines 15 and 19 of the signal line 9 and the ground 13 have been explained as using the signal line and ground etching mask pattern formed by the photolithography process, but it can be carried out by using other methods, e.g., a laser trimming method, etc.

Thereafter, to form a first air cavity sacrificing layer pattern 19, a first sacrificing layer (not shown) is formed over the substrate 11 on which the first and the second switching lines 15 and 19 of the signal line 9 and the ground 13 are formed. The first sacrificing layer is made of a material such as a photoresist having an etching selectivity higher than that of the substrate 11, the first and the second switching lines 15 and 19, the ground 13, and the membrane 27, so as to be removed by an etching process later. The first sacrificing layer functions to separate a second switching contact 25 of the switching unit 22, which is later formed on the first air cavity sacrificing layer pattern 19 in the second air cavity 37*b*, from a first and a second switching ends 17*a* and 17*b* of the second switching line 17 without joining it thereto.

After the first sacrificing layer is formed, a first sacrificing layer etching mask pattern (not shown) having the pattern of the groove part 12 is formed by a photolithography process. At this time, if the plurality of etching passages 51 to etch and remove the first and the second air cavity sacrificing pattern 19 and 21 are formed at the substrate 11, the first sacrificing layer etching mask pattern is configured to further include the pattern of etching passages 51, so that a portion of the first sacrificing layer formed on the portion of the substrate 11 at which the etching passages 51 are formed will not be removed during the following etching process.

Subsequently, the first sacrificing layer is etched by using the first sacrificing layer etching mask pattern as an etching mask, and the first sacrificing layer etching mask pattern is removed. As a result, the first air cavity sacrificing layer pattern 19 is formed on the groove part 12 of the substrate 11. A portion of the first air cavity sacrificing layer pattern 19 positioned on the second trench 12*b* defines a shape of an inner surface of a second flexible dome 27*b* of a membrane 27 which is in a compressed state.

Thereafter, the substrate 11 over which the first air cavity sacrificing layer pattern 19 is formed is cured at a temperature of about 200~300° C.

Subsequently, a second sacrificing layer (not shown) is formed with the same material as that of the first sacrificing layer, that is, a photoresist over the substrate 11 over the first air cavity sacrificing layer pattern 19 is formed. The thickness of the second sacrificing layer formed on the first air cavity sacrificing layer pattern 19 determines a volume or quantity of air which is later filled in the first variable air cavity 30*a*.

Figure 3C:
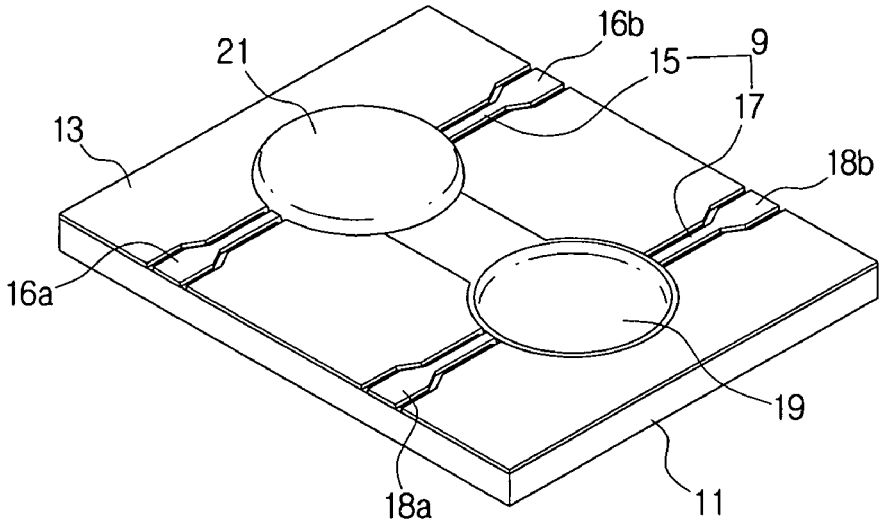

After the second sacrificing layer is formed, a second sacrificing layer etching mask pattern (not shown) having a pattern of the first variable air cavity 30*a* is formed by a photolithography process on the second sacrificing layer. Next, the second sacrificing layer is etched by using the second sacrificing layer etching mask pattern as an etching mask, and the second sacrificing layer etching mask pattern is removed. As a result, as shown in FIG. 3C, the second air cavity sacrificing layer pattern 21 is formed on the first air cavity sacrificing layer pattern 19. The second air cavity sacrificing layer pattern 21 defines a shape of an inner surface of a first flexible dome 27*a* of a membrane 27 which is in an expanded state.

Thereafter, the substrate 11 over which the first and the second air cavity sacrificing layer patterns 19 and 21 is formed is cured at a temperature of about 200~300° C.

Figure 3D:
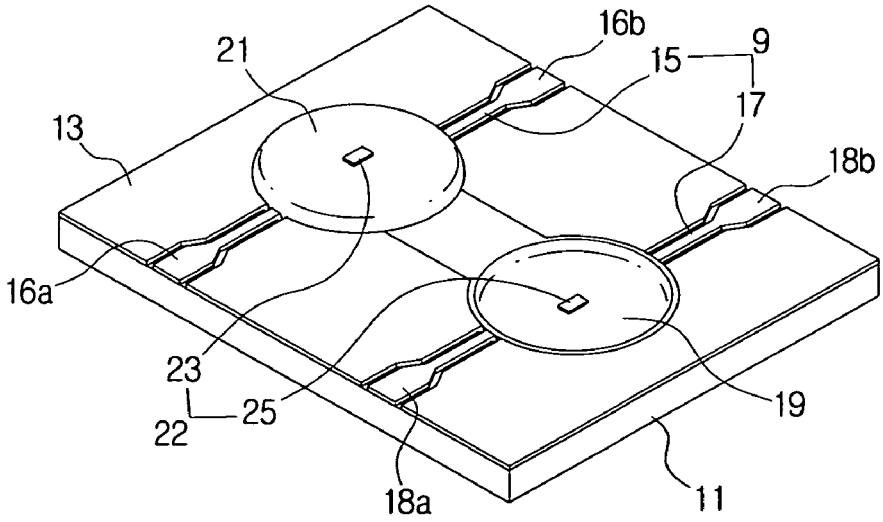

Next, to form the first and the second switching contacts 23 and 25 of the switching unit 22, a second metal layer (not shown) made of Au, Pt, Rh, or Ir is deposited over the substrate 11, and patterned by a method which etches by using a contact etching mask pattern (not shown) formed on the second metal layer by a photolithography process as an etching mask, or a laser trimming method. As a result, as shown in FIG. 3D, the first and the second switching contacts 23 and 25 are formed on the first air cavity sacrificing layer patterns 19 over the second trench 12*b* and the second air cavity sacrificing layer patterns 21, respectively.

Subsequently, a membrane layer is formed with a silicon nitride, a silicon oxide, or a parylene, which is a flexible dielectric substance, over the substrate 11 over which the first and the second switching contacts 23 and 25.

After the membrane layer is formed, a membrane etching mask pattern (not shown) having a pattern of the membrane 27 is formed on the membrane layer by a photolithography process.

Next, the membrane layer is etched by using the membrane etching mask pattern as an etching mask, and the membrane etching mask pattern is removed. As a result, the membrane 27, which covers the first and the second air cavity sacrificing layer patterns 19 and 21, is formed over the substrate 11.

Figure 3E:
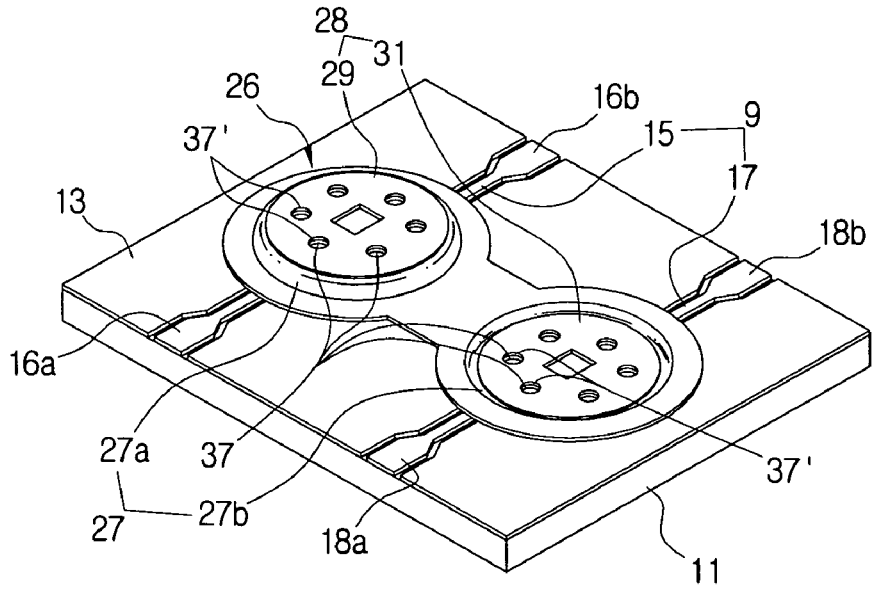

Thereafter, to form a first and a second driving electrodes 29 and 31 of a driving unit 28, a third metal layer made of Al, Mo, or Ta is deposited over the substrate 11 over which the membrane 27 is formed, and patterned by a method which etches by using a driving electrode etching mask pattern (not shown) having a pattern of the second etching holes 37' formed on the third metal layer by a photolithography process as an etching mask, or a laser trimming method. As a result, as shown in FIG. 3E, the first and the second driving electrodes 29 and 31 having the second etching holes 37' are formed on the membrane 27.

After the first and the second driving electrodes 29 and 31 are formed, the membrane 27 is patterned by a method which etches by using the driving electrode etching mask pattern as an etching mask or a laser trimming method to form first etching holes 37, and the driving electrode etching mask pattern is removed. As a result, the first etching holes 37 are formed at the membrane 27.

After the first etching holes 37 are formed, the first and the second air cavity sacrificing layer pattern 19 and 21 are removed through the first and etching holes 37 and 37' by a wet etching process of using a solvent having an etching selectivity with respect to the photoresist of the first and the second sacrificing layers, or an ashing process of using $O_2$ plasma. At this time, as shown in FIG. 6, if in order to etch and remove the first and the second air cavity sacrificing layer pattern 19 and 21, the etching passages 51 are formed at the substrate 11 instead of forming the first and the second etching holes 37 and 37' at the membrane 27 and the first and the second driving electrodes 29 and 31, the first and the second air cavity sacrificing layer pattern 19 and 21 are removed through the etching passages 51.

To seal the first and the second etching holes 37 and 37' after the first and the second air cavity sacrificing layer pattern 19 and 21 are removed, a sealing layer (not shown) is formed over the substrate 11 over which the membrane 27 is formed. At this time, like as the membrane layer, the sealing layer is made of a silicon nitride film, a silicon oxide film, or a parylene, which is a flexible dielectric substance.

Figure 3F:
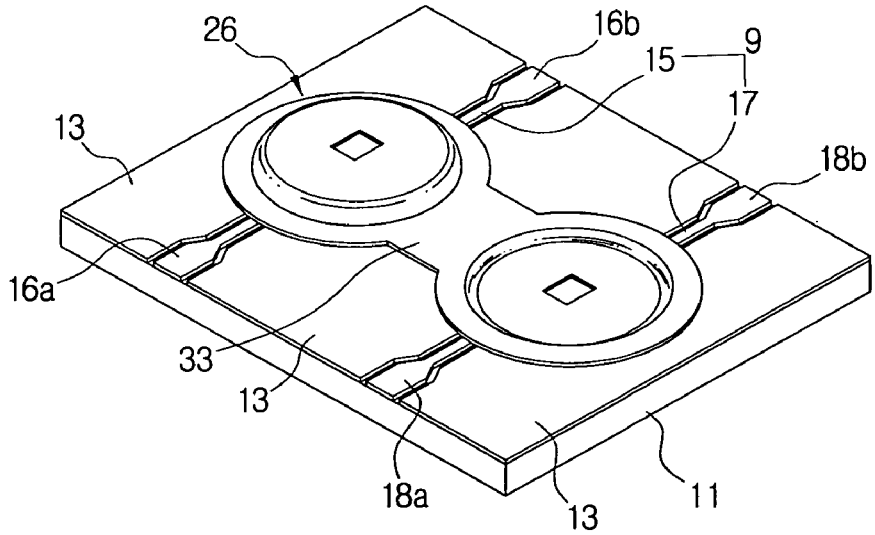

After the sealing layer is formed, a seal etching mask pattern (not shown) having a pattern of the membrane 27 is formed on the sealing layer with a photolithography process. Next, the sealing layer is etched by using the seal etching mask pattern as an etching mask, and the seal etching mask pattern is removed. As a result, as shown in FIGS. 3F and 5, the membrane 27 sealed with a seal 33 is formed, and the process of fabricating the pneumatic RF MEMS switch 10 is completed.

Alternatively, if the first and the second air cavity sacrificing layer patterns 19 and 21 are not removed through the first and the second etching holes 37 and 37', but the etching passages 51, the etching passages 51 of the substrate 11 are sealed with metal balls 52 made of a metal such as Au, as shown in FIG. 6. To be more specific, after the first and the second air cavity sacrificing layer patterns 19 and 21 are removed, the metal balls 52 are inserted into the etching passages 51, and the substrate 11 in which the metal balls 52 are inserted into the etching passages 51 is heated so as to allow the metal balls 52 to be fused in the etching passages 51 and thus to seal the etching passages 51. Also, at this time, in order to protect the first and the second driving electrodes 29 and 31 of the driving unit 28, a protecting layer 33' (see FIG.

6) is formed with the same material as that of the membrane 27 over the substrate 11 over which the first and the second driving electrodes 29 and 31 are formed, as the same manner as that of the sealing layer as described above.

As apparent from the foregoing description, the pneumatic RF MEMS switch in accordance with the exemplary embodiment of the present invention can be operated with a small force. Further, the pneumatic RF MEMS switch in accordance with the exemplary embodiment of the present invention operates to bring together or separate the switching contacts of the switching unit from the switching ends of the corresponding switching lines by the membrane having the plurality of variable air cavities communicating with each other in such a manner that when one of the plurality of variable air cavities is compressed, the rest are expanded. Accordingly, as compared with the conventional RF MEMS switch having the switch pad supported to the supporting spring, the dielectric beam, the conductive pad, or the movable body, the pneumatic RF MEMS switch in accordance with the exemplary embodiment of the present invention can be not only driven with a lower voltage, but also remove the problem which the switch pad is easily vibrated due to the supporting spring with the low elastic modulus, the problem which the movable transmission line segment is stuck with the friction or the collision during the operation of the dielectric beam, and the problem which the conductive pad or the movable body guided by the bracket or the guidepost generates electric connection error, thereby greatly improving a reliability in operation of the switch. Further, since the pneumatic RF MEMS switch the same in accordance with the exemplary embodiment of the present invention does not use weak parts such as the supporting spring which is designed with the low elastic modulus, a reliability in fabrication of the switch can be improved.

Also, the pneumatic RF MEMS switch in accordance with the exemplary embodiment of the present invention has a structure, in which the switching contacts of the switching unit and the switching ends of the switching lines are sealed with the membrane. Accordingly, the pneumatic RF MEMS switch and the method of fabrication the same in accordance with the exemplary embodiment of the present invention do not need of a separate packaging member and/or a separate packaging process to seal the switching contacts and the switching ends, thereby reducing fabrication costs.

Although representative exemplary embodiments of the present invention have been shown and described in order to exemplify the principle of the present invention, the present invention is not limited to the specific embodiments. It will be understood that various modifications and changes can be made by one skilled in the art without departing from the spirit and scope of the invention as defined by the appended claims. Therefore, it shall be considered that such modifications, changes and equivalents thereof are all included within the scope of the present invention.

What is claimed is:

1. A pneumatic micro electro mechanical system switch comprising:

a substrate;

a pneumatic actuating unit disposed on the substrate, comprising a plurality of variable air cavities communicating such that when at least one of the plurality of variable air cavities is compressed, the rest are expanded;

a signal line having a plurality of switching lines, each of which passes through a corresponding one of the plurality of variable air cavities and has a first and a second switching ends disposed in a spaced-apart relation with each other in the corresponding one of the plurality of variable air cavities;

a switching unit movable with the pneumatic actuating unit to connect the first and the second switching ends of each of the plurality of switching lines when each of the plurality of variable air cavities is compressed; and a driving unit to drive the pneumatic actuating unit so as to selectively compress at least one of the plurality of variable air cavities, wherein at least one of the plurality of variable air cavities is always maintained as compressed, and wherein the plurality of switching lines is disposed on and along bottom walls of a plurality of trenches formed in the substrate.

2. The switch as claimed in claim 1, wherein the substrate is formed of one selected from a high resistivity silicon and a quartz.

3. The switch as claimed in claim 1, wherein the pneumatic actuating unit further comprises a membrane to enclose the plurality of trenches formed at the substrate to form the plurality of variable air cavities.

4. The switch as claimed in claim 3, wherein the membrane is formed of one selected from a silicon oxide film, a silicon nitride film and a parylene.

5. The switch as claimed in claim 3, wherein the membrane has a plurality of first etching holes to remove a sacrificing layer pattern for forming the plurality of variable air cavities during a fabrication, and wherein the plurality of first etching holes are sealed with a seal.

6. The switch as claimed in claim 3, wherein the membrane has a plurality of first etching holes to remove a sacrificing layer pattern for forming the plurality of variable air cavities during a fabrication, and wherein at least one of the plurality of first etching holes is not sealed with a seal within a range where the membrane is operable such that when the at least one of the plurality of variable air cavities is compressed, the rest are expanded.

7. The switch as claimed in claim 3, wherein each of the plurality of switching lines comprises a coplanar wave guide spaced apart from a ground formed on the plurality of trenches, so as to transmit a signal with an electronic field.

8. The switch as claimed in claim 7, wherein the ground and the signal line are formed of one selected from Au and Pt, respectively.

9. The switch as claimed in claim 3, wherein the switching unit comprises a plurality switching contacts, each of which is formed opposite to the first and the second switching ends of each of the plurality of switching lines in each of the plurality of variable air cavities.

10. The switch as claimed in claim 9, wherein the plurality of switching contacts is formed of one selected from Au, Pt, Rh and Ir, respectively.

11. The switch as claimed in claim 9, wherein the driving unit comprises:

a ground formed on the plurality of trenches in the plurality of variable air cavities; and a plurality of driving electrodes, each of which is formed opposite to the ground on the corresponding one of the plurality of trenches, to generate an electrostatic force with the ground therebetween when a voltage is applied and compress the corresponding one of the plurality of variable air cavities of the membrane.

12. The switch as claimed in claim 11, wherein the plurality of driving electrodes is formed of one selected from Al, Mo, and Ta, respectively.

13. The switch as claimed in claim 11, wherein each of the plurality of driving electrodes has a plurality of second etching holes to remove a sacrificing layer pattern for forming the plurality of variable air cavities during a fabrication, and wherein the plurality of second etching holes are sealed with a seal.

14. The switch as claimed in claim 11, wherein each of the plurality of driving electrodes has a plurality of second etching holes to remove a sacrificing layer pattern for forming the plurality of variable air cavities during a fabrication, and wherein at least one of the plurality of second etching holes is not sealed with a seal within a range where the membrane is operable in such a manner that when the at least one of the plurality of variable air cavities is compressed, the rest are expanded.

15. The switch as claimed in claim 11, wherein the plurality of trenches, the plurality of variable air cavities, the plurality of switching lines, the plurality of switching contacts, and the plurality of driving electrodes comprise two trenches, two variable air cavities, two switching lines, two switching contacts, and two driving electrodes, respectively.

16. The switch as claimed in claim 11, wherein the plurality of trenches, the plurality of variable air cavities, the plurality of switching lines, the plurality of switching contacts, and the plurality of driving electrodes comprise at least three trenches, at least three variable air cavities, at least three switching lines, at least three switching contacts, and at least three driving electrodes, respectively, and wherein the plurality of trenches and the plurality of variable air cavities are arranged in series and formed to communicate with one another, respectively.

17. The switch as claimed in claim 11, wherein the plurality of trenches, the plurality of variable air cavities, the plurality of switching lines, the plurality of switching contacts, and the plurality of driving electrodes comprise at least three trenches, at least three variable air cavities, at least three switching lines, at least three switching contacts, and at least three driving electrodes, respectively, and wherein the plurality of trenches and the plurality of variable air cavities are configured in such a manner that at least one of the plurality of trenches and the plurality of variable air cavities is disposed in a center of the rest and formed to communicate with one another, respectively.

18. The switch as claimed in claim 11, wherein the plurality of trenches, the plurality of variable air cavities, the plurality of switching contacts, and the plurality of driving electrodes constitute a plurality of switch units, each of which is formed of two trenches, two variable air cavities, two switching contacts, and two driving electrodes, and wherein the plurality of switch units are successively connected with one another in such a manner that one unit is disposed in parallel with another two units.

19. The switch as claimed in claim 1, further comprising a ground disposed on and along side walls of the plurality of trenches.

* * * * *